US006871685B2

(12) United States Patent
Freney

(10) Patent No.: US 6,871,685 B2
(45) Date of Patent: Mar. 29, 2005

(54) ANTI-FLAP CLAMP

(76) Inventor: Michael E Freney, P.O. Box 1030, Eagle Farm, Queensland (AU)

( * ) Notice: Subject to any disclaimer, the term of this patent is extended or adjusted under 35 U.S.C. 154(b) by 0 days.

(21) Appl. No.: 10/114,496

(22) Filed: Apr. 2, 2002

(65) Prior Publication Data

US 2002/0162198 A1 Nov. 7, 2002

Related U.S. Application Data

(60) Provisional application No. 60/280,990, filed on Apr. 4, 2001.

(51) Int. Cl.[7] ..... E04F 10/06

(52) U.S. Cl. ..... 160/67; 160/269

(58) Field of Search ..... 160/66, 67, 22, 160/68, 71, 80, 269, 399, 402; 135/88.11, 88.12

(56) References Cited

U.S. PATENT DOCUMENTS

| | | | | | |
|---|---|---|---|---|---|
| 297,667 | A | * | 4/1884 | Brown | 160/269 |
| 566,284 | A | * | 8/1896 | Casselberry | 160/269 |
| 2,548,041 | A | * | 4/1951 | Morse | 160/23.1 |
| 3,172,419 | A | | 3/1965 | Lewis | 135/6 |
| 4,077,419 | A | * | 3/1978 | Lux | 160/66 X |
| 4,231,141 | A | | 11/1980 | Derrick et al. | 24/243 K |
| 4,301,851 | A | * | 11/1981 | Gitkin | 160/66 X |
| 4,317,480 | A | * | 3/1982 | Phelps | 160/269 X |
| 4,682,618 | A | | 7/1987 | Zwick | 135/89 |
| 4,887,324 | A | | 12/1989 | Cairns | 4/609 |
| 5,092,388 | A | * | 3/1992 | Evers | 160/269 |
| 5,314,153 | A | * | 5/1994 | White | 160/45 |
| 5,369,850 | A | * | 12/1994 | Noble | 160/67 X |
| 5,592,982 | A | * | 1/1997 | Murray et al. | 160/67 |
| 5,909,761 | A | * | 6/1999 | Murray | 160/71 |
| 6,179,513 | B1 | * | 1/2001 | Marasco | 160/71 X |

* cited by examiner

*Primary Examiner*—David Purol

(57) ABSTRACT

A collapsible awning assembly 10 fitted to the side of a caravan 11 and equipped with two anti-flap clamp assemblies 11 land 12. The awning assembly 10 comprises a fabric sheet material 13 which is stored on a roller 14 and held in its extended position by respective stays 15 at each end of the awning assembly. The clamp assemblies 11 and 12 are identical and are equipped at each end with transverse member attachment means 16 and 17 so that the clamp assemblies effectively form pole rafters extending rigidly between transverse members formed by the top surround of the caravan 18 and the brace 15 or the end portion of the roller 14 where the clamp assembly is attached at 17. The clamp assemblies 11 and 12 are telescopic assemblies having telescopic connectors 19 which hold spaced apart clamps comprising first longitudinal clamp members and second longitudinal clamp members 20 which overlay the first longitudinal clamp members, the spaced apart clamps securing marginal edge portions of the sheet material 13 to inhibit flapping.

26 Claims, 6 Drawing Sheets

ANTI-FLAP CLAMP

This application claims the benefit of provisional application No. 60/280,990, filed Apr. 4, 2001.

TECHNICAL FIELD OF THE INVENTION

This invention relates to an anti-flap clamp and in particular but not limited to an anti-flap clamp preventing flapping of flexible sheet material, as may be used in awnings. In a preferred form, the invention relates to a collapsible awning assembly with improved anti-flap characteristics.

BACKGROUND TO THE INVENTION

It is common to make use of fabric awnings to provide shelter, external to, and associated with, a structure such as a caravan, boat cabin, cafe, house, motor home or other recreational vehicle. Under windy conditions, the awning may flap at the edges, in some cases quite severely. Consequently, in order to prevent damage, the awning may have to be dismantled or, in the case of collapsible awnings, the awning must be moved from its extended position to a safe storage position. This is inconvenient since the owner of the awning may not always be present when the windy conditions arise.

There have been many methods used to control awning wind flap. These include using ropes or straps over the top of the awning which are then placed in tension connected to the ground or a support. In another effort to overcome this problem, short individual clips or clamps have also been fitted along the edge of the fabric in order to reduce flap. Unfortunately, these methods have been somewhat inconvenient or provided less than desirable results.

It is an object of the present invention to provide a means for substantially reducing the problem of awning flap as an alternative to those known in the prior art.

OUTLINE OF THE INVENTION

According to one aspect, the present invention resides in an anti flap clamp adapted to secure an edge of a flexible sheet material, the clamp having a first longitudinal clamp member and a second longitudinal clamp member held together by clamp fastener means, the clamp fastener means being operable to secure the clamp members in a sheet clamping position from a sheet release position, the clamp members having axially extending clamping parts adapted to engage along a margin of the edge of the sheet material to clamp the edge, characterized in that no component of the clamp is required to be permanently secured to the sheet material and that the sheet material, when clamped, exhibits no or minimal lateral displacement at the margin when the clamp members are in the clamping position.

Preferably, the clamping parts of the clamp members co-act so that the sheet material clamped will be minimally displaced laterally when the clamp members are in the clamping position.

Preferably, the clamping parts comprise co-operating non-straight surfaces adapted to retain the sheet material therebetween when the clamp members are in the clamping position.

Preferably, the axially extending clamping part of the first longitudinal clamp member is an outer surface of a hollow rail, the surface being equipped with projections.

Preferably, the first longitudinal clamp member is length adjustable.

More preferably, said first longitudinal clamp member is length adjustable by being foldable or adjustable telescopically.

Most preferably, the first longitudinal clamp member is length adjustable telescopically.

Preferably, the anti-flap clamp further includes a releasable frictional fastener to secure the telescopically adjustable first longitudinal clamp member against telescopic movement.

Preferably, the first longitudinal clamping member further includes a transverse member attachment means adapted to attach the first longitudinal clamping member to a fixture supporting the sheet material.

Preferably, the second longitudinal clamp member comprises a C-shaped rail.

Preferably, the C-shaped rail includes an inner surface clamping part adapted to cooperate with the outer surface of the first longitudinal clamp member.

More preferably, the inner surface of the C-shaped rail includes a layer of resilient material.

Preferably, the resilient material is adapted to deform when clamped against the projections of the first longitudinal clamp member.

Preferably, the first longitudinal clamp member is connected at its opposite ends to the respective transverse member attachment means, the first longitudinal clamping member providing a fixed jaw carrying the clamping part of the first longitudinal clamping member and the second longitudinal clamp member providing a movable jaw carrying the clamping part of the second member.

Although the first and second longitudinal clamp members may be stored as separate members and simply bolted together to secure them in the sheet clamping position, preferably, the first longitudinal clamp member and the second longitudinal clamp member are pivotally coupled together using a pivot connection.

Preferably, the first longitudinal clamp member includes an extruded pivot rail extending parallel to the clamping part of the first longitudinal clamp member, and the second longitudinal clamp member includes an extruded C-shaped channel extending parallel to the clamping part of the second longitudinal clamp-member, the pivot rail being positioned in the C-shaped channel so that the clamping parts can pivot together between the sheet release and sheet clamping positions.

Preferably, the clamp fastener means comprise longitudinally spaced apart quick release mechanisms.

Preferably, the spaced quick release mechanisms include manually operable levers equipped with over centre cam surfaces for over centre toggle operation between the sheet clamping and sheet release positions.

More preferably, the tension applied by each spaced quick release mechanism when in the sheet clamping position is adjustable.

Preferably, the first longitudinal clamp member further includes at least one channel adapted to retain a second sheet material therein, the second sheet material functioning as a wall or similar for the awning.

More preferably, there are two such channels.

In another aspect, the present invention resides in a collapsible awning assembly with improved anti-flap characteristics, the collapsible awning assembly having (1) a flexible sheet material supported at opposite sides by transverse members, the flexible sheet material having opposite free edges extending laterally of the transverse members and (2) at least one anti-flap clamp removably attached to the transverse members and adapted to extend along a margin of at least one of the free edges, wherein each anti-flap clamp is as hereinbefore described.

In a still further aspect, there is provided by the present invention an elongate clamp assembly having spaced apart anti-flap clamps, each anti-flap clamp as hereinbefore described.

BRIEF DESCRIPTION OF THE DRAWINGS

In order that the present invention can be more readily understood and be put into practical effect, reference will now be made to the accompanying drawings by way of non-limiting example illustrating the application of the present invention to a caravan and wherein.

DETAILED DESCRIPTION OF EMBODIMENTS

Figure 1:
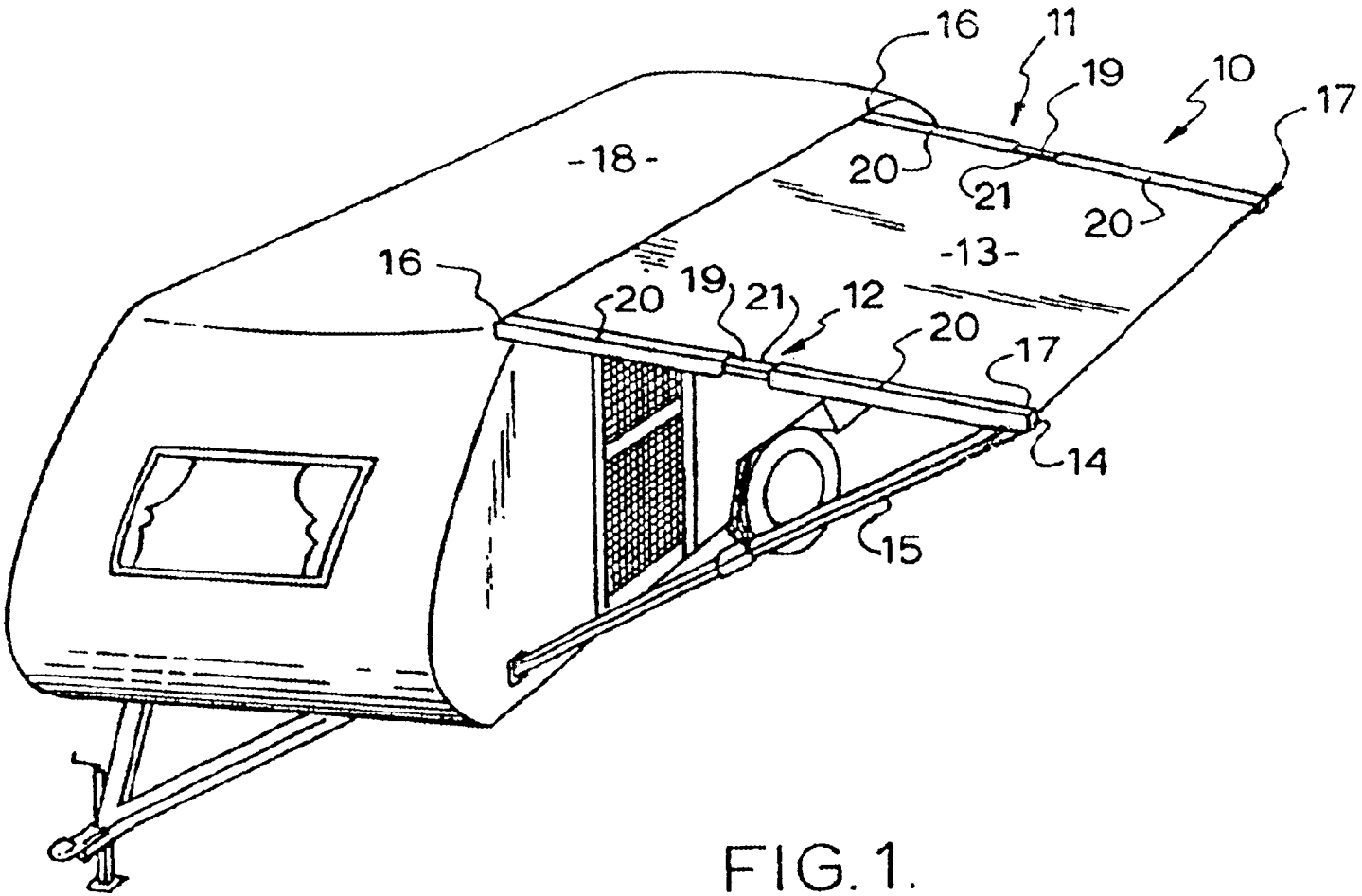
FIG. 1 is a perspective drawing illustrating a caravan equipped with a collapsible awning assembly according to the present invention, the collapsible awning assembly having two clamp assemblies according to the present invention, each clamp assembly having a pair of anti-flap clamps according to the present invention.

Referring to the drawings and initially to FIG. 1, there is illustrated a collapsible awning assembly 10 fitted to the side of a caravan and equipped with two anti-flap clamp assemblies 11 and 12. The awning assembly 10 comprises a fabric sheet material 13 which is stored on a roller 14 and held in its extended position by respective stays 15 at each end of the awning assembly 10. The clamp assemblies 11 and 12 are identical and are equipped at each end with transverse member attachment means shown generally at 16 and 17 (see also FIGS. 9 and 10 for examples) so that the clamp assemblies effectively form pole rafters extending rigidly between transverse members formed by the top surround 18 of the caravan and the brace 15 or the end portion of the roller 14 where the clamp assembly is attached at 17. The clamp assemblies 11 and 12 are telescopic assemblies having telescopic connectors 19 which hold spaced apart clamps comprising first longitudinal clamp members (not visible), second longitudinal clamp members 20 which overlay the first longitudinal clamp members, the spaced apart clamps secure marginal edge portions of the sheet material 13.

There is only a small portion of the edge of the sheet illustrated at 21 that is not clamped. This is in the region of the telescopic connector 19.

To collapse the assembly of FIG. 1, the second clamp members 20 are released to release the edges of the sheet material, frictional fasteners that are used to hold the telescopic first clamp member in its extended position are released and this enables the attachment means 16 and 17 to be released so that the clamp assemblies 11 and 12 can be completely removed. The awning is then retracted by releasing the stays 15 and rolling the sheet onto the roller 14.

It will be appreciated in relation to FIG. 1 that the first longitudinal clamp members in conjunction with the telescopic connector will provide a fixed rigid rail and that the second clamp members 20 are moveable relative to that fixed rail.

The actual operation of the clamp members in the preferred embodiment will now be described in relation to FIGS. 2 to 5 & 8. Like numerals illustrate like features. As can be seen from FIGS. 2 and 3 the first longitudinal clamp member of each clamp comprises a hollow rail 22 which in use with the connector 19 effectively forms a rafter for the awning of FIG. 1. The connector 19 is sized to fit telescopically within the passage 23 to connect two sections of the extrusion 22 together so that the rafter can be extended and retracted as previously described. A C-shaped slot 24 is provided so that a rope 99 fitted to a second sheet material 98 can be fed in and thereby attached to the rail 22 for the purpose of providing a wall if desired. While one channel 24 is illustrated, it is preferable that two C-shaped channels be utilized side by side.

The extrusion 22 includes a flange 25 and a projecting pivot rail 26, the flange 25 having spaced holes 27 which take a quick release fastener assembly which in this case is an over centre toggle assembly 28. The toggle assembly 28 (FIG. 8) includes a pivot pin 97 with a threaded end portion 96 to which a nut 95 can be affixed. The pin 97 can pivot in a slot 94 in the body of the assembly 28. The pin 97 and the nut 95 are adapted such that the pin 97 can pass through the respective holes 27 whereby, by appropriate positioning of the nut 95, the tension between the rail 22 and the second clamp member 20 can be adjusted thus varying the clamping force applied to the sheet material 13 held therebetween as the clamp member 20 is moved between the release position illustrated in FIG. 2 and the clamping position illustrated in FIG. 3.

Figure 3:
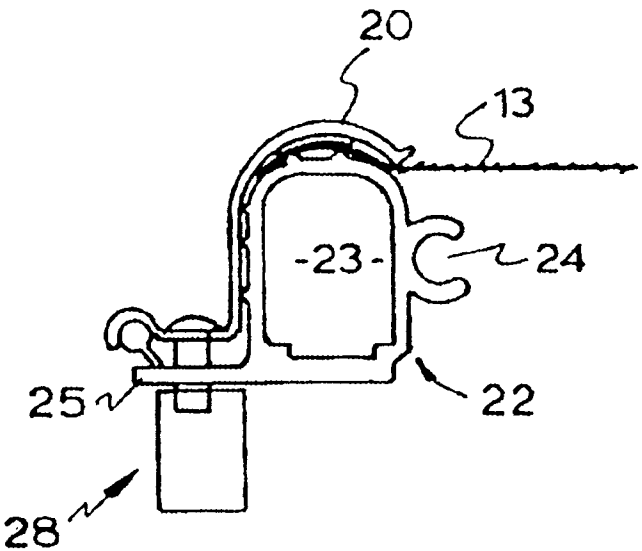
FIGS. 2 and 3 are sections used to illustrate a preferred anti-flap clamp in the sheet release and sheet clamping positions respectively.
Figure 2:
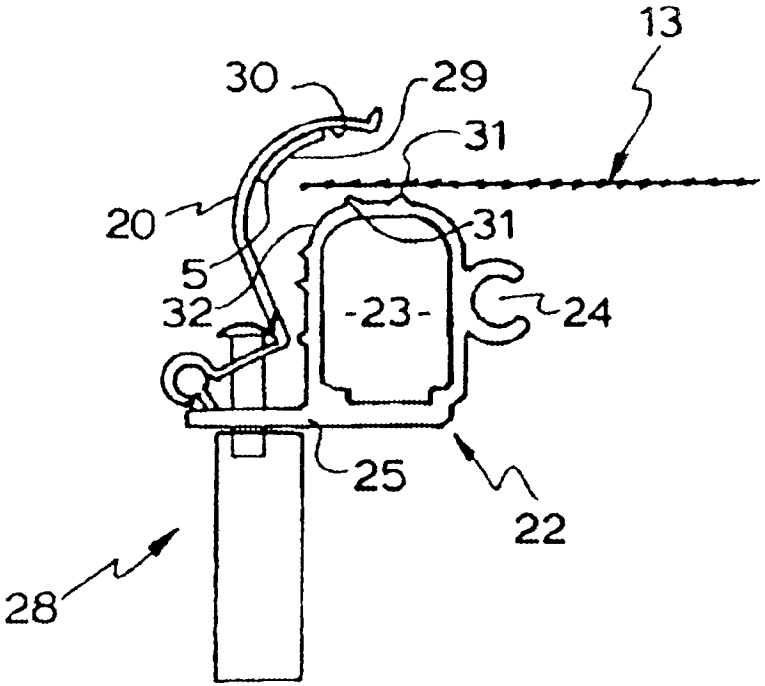
Figure 5:
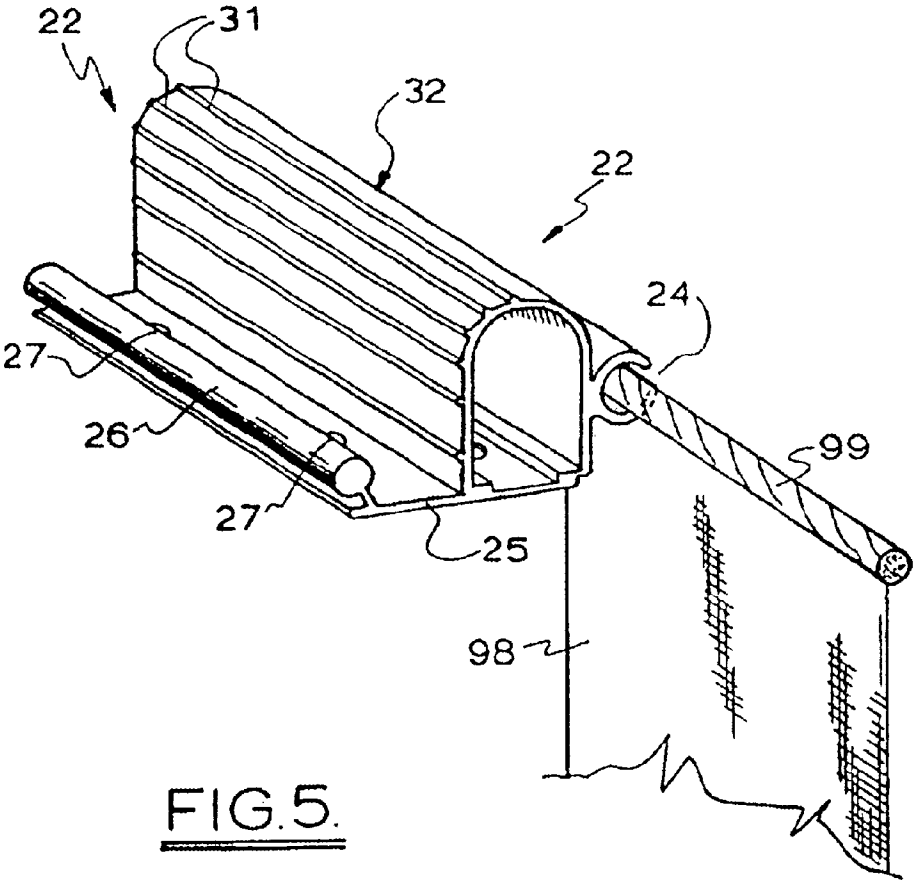
FIG. 5 is a perspective drawing illustrating a typical first clamp member in the form of an extruded rail.
Figure 4:
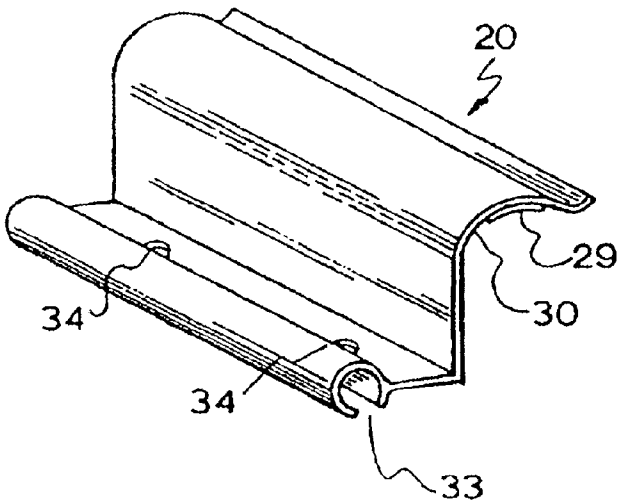
FIG. 4 is a perspective drawing illustrating a typical second clamp member in the form of an extruded rail.

The first clamp member 20 includes a clamping part having rubber material or other resilient material 29 adhered to an inner surface 30 of the clamp member 20 while the clamp member 22 includes a clamping part having spaced parallel ridges 31 projecting from a surface 32, it being appreciated that the surfaces 30 and 32 are generally curved and co-act to support and retain a marginal edge portion of the sheet material 13 by causing lateral displacement of the sheet material when the quick release toggle 28 is in the position illustrated in FIG. 3 and the clamping members 20 and 22 are in the clamping position.

The second clamp member 20 includes an extruded slot 33 which co operates with the pivot rail 26. Holes 34 are aligned with the holes 27 in the rail 22 and in conjunction with the over centre toggle make provision for the toggle action illustrated in relation to FIGS. 2 and 3.

Figure 6:
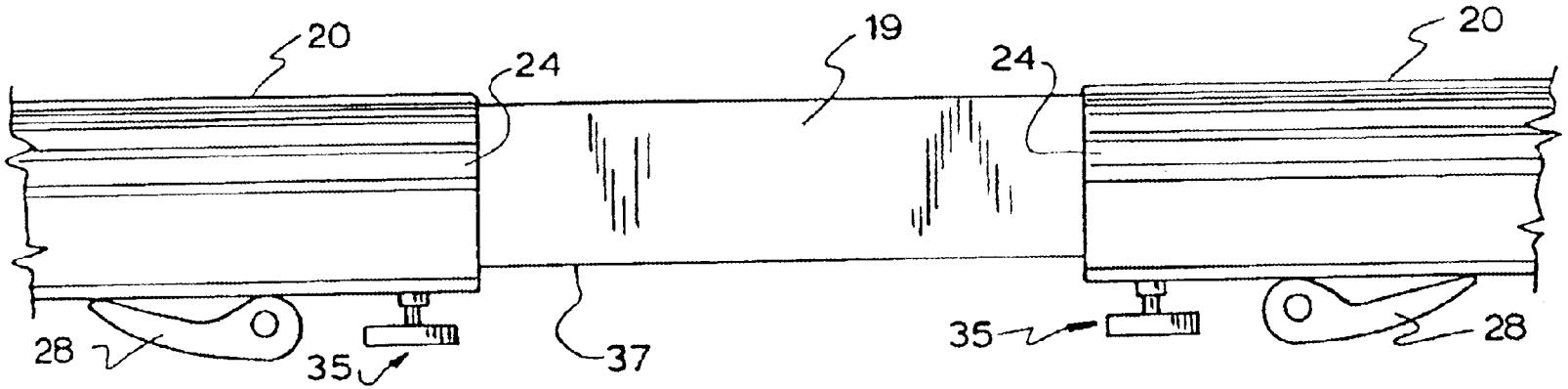
FIG. 6 is a drawing illustrating a preferred clamp assembly formed as a telescopic assembly of two spaced pairs of clamp members and a telescopic connector.
Figure 8:
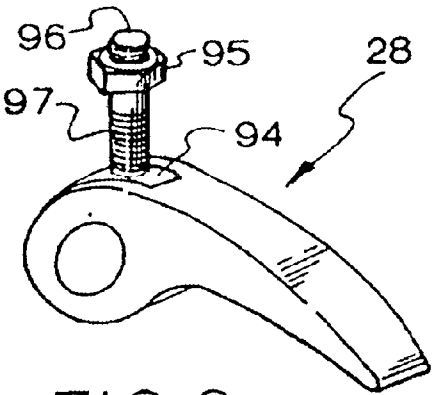
FIG. 8 is a drawing illustrating a typical over-centre quick release mechanism.
Figure 7:
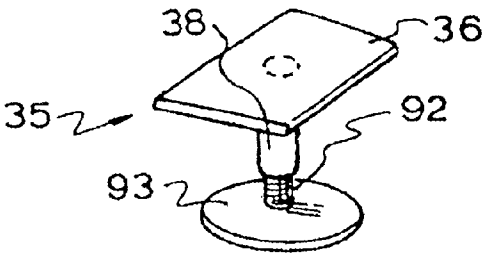
FIG. 7 is a drawing illustrating a frictional engagement fastener used to releasably secure the telescopic assembly of FIG. 6 against telescopic movement.

Referring to FIGS. 6 & 7, the clamp assembly 11, 12 is illustrated as viewed from the side of the slot 24, the telescopic movement of the assembly is restrained or released by releasable frictional fasteners 35 which, in this case, use a stainless steel plate 36 which includes a hollow threaded spigot 38 which is engaged in a corresponding bore in the base of the hollow rail 22. A wheel 93 with a threaded spigot 92 engages the threaded hollow of the spigot 38 allowing the plate 36 to frictionally engage the surface 37 of the connector 19.

Figure 9:
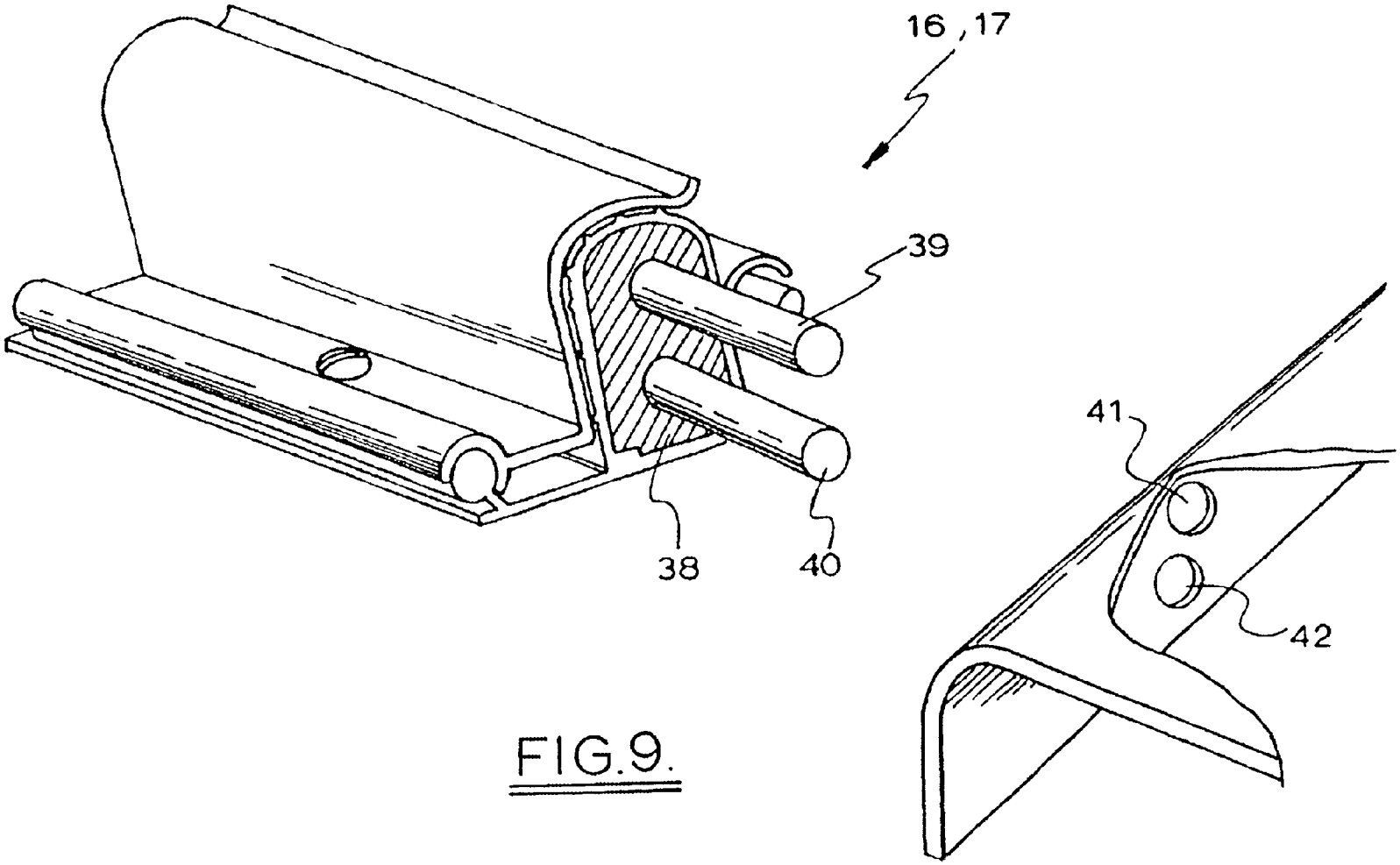
FIG. 9 is an exploded perspective drawing illustrating a typical transverse member attachment means.
Figure 10:
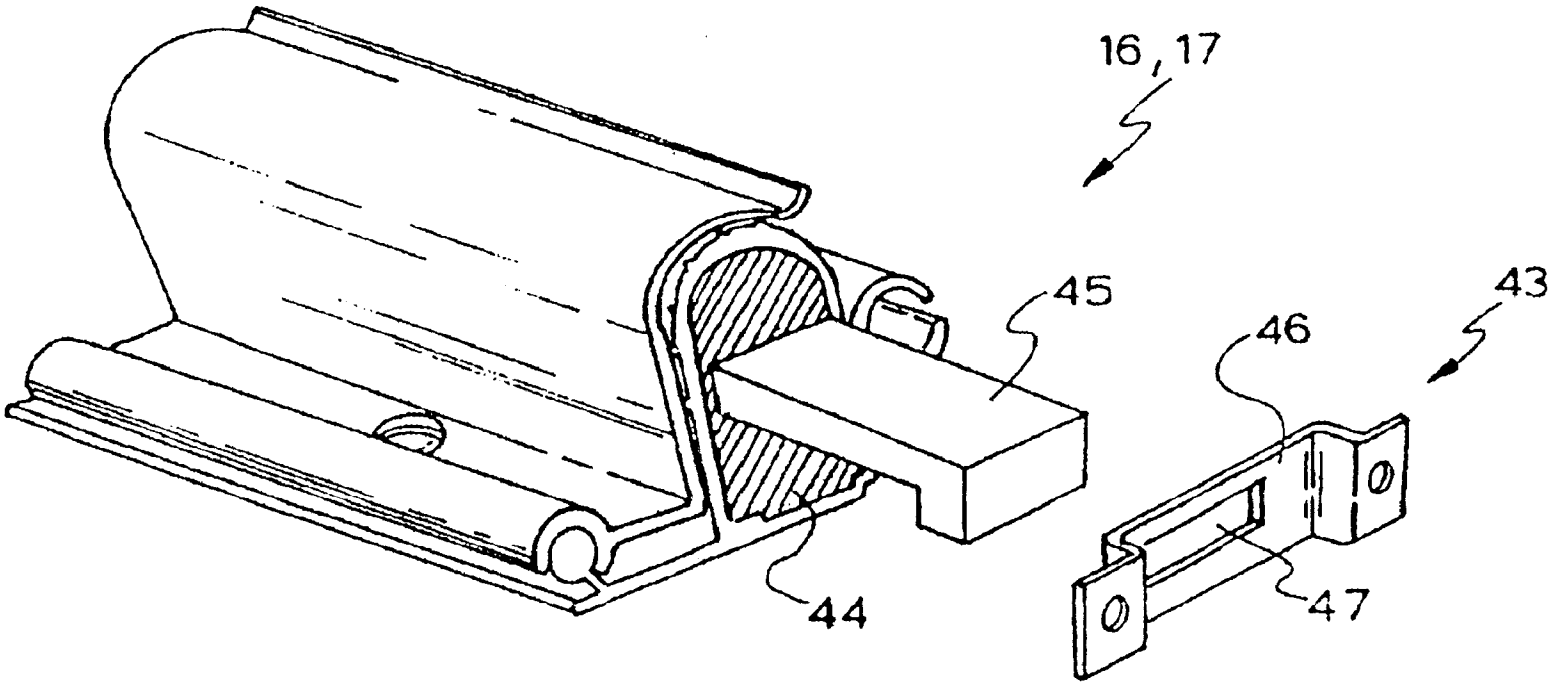
FIG. 10 is an exploded drawing illustrating in a further embodiment a transverse member attachment means.

Typical attachment means 16, 17 are illustrated in relation to FIGS. 9 and 10. In FIG. 9, an insert 38 carries spigots 39 and 40 which can simply fit into holes 41 and 42 in the top surround of the caravan as illustrated at 16 in FIG. 1. Similar spigot arrangements can be utilized with corresponding holes adjacent the ends of the roller 14 as illustrated at 17 in FIG. 1. An alternative where it is not applicable to locate holes is the arrangement of FIG. 10 where a bracket 43 in conjunction with an insert 44 and a hook 45 is used. The hook 45 passes over the projecting portion 46 of the bracket 43 or can be suitably sized to pass through the aperture 47 of the bracket 43. The bracket 43 can be secured to the surround of the caravan as illustrated at 16 in FIG. 1 while the spigots can be used at the opposite end at 17.

Whilst the above has been given by way of illustrative example of the present invention, many variations and modifications thereto will be apparent to those skilled in the art without departing from the broad ambit and scope of the invention as defined in the appended claims.

What is claimed is:

1. An anti-flap clamp adapted to secure an edge of a flexible sheet material, the clamp having a first longitudinal clamp member and a second longitudinal clamp member held together by clamp fastener means, the clamp fastener means being operable to secure the clamp members in a sheet clamping position from a sheet release position, the first and second longitudinal clamp members each having axially extending clamping parts adapted to engage along a margin of the edge of the sheet material to clamp the edge, wherein the axially extending clamping part of the first longitudinal clamp member is an outer surface of a hollow rail, the surface being equipped with projections, so that no component of the clamp is required to be permanently secured to the sheet material and that the sheet material, when clamped, exhibits no or minimal lateral displacement at the margin when the clamp members are in the clamping position.

2. An anti-flap clamp according to claim 1 wherein the axially extending clamping parts of the clamp members co-act so that the sheet material clamped will be minimally displaced laterally when the clamp members are in the clamping position.

3. An anti-flap clamp according to claim 1 wherein the axially extending clamping parts comprise co-operating non-straight surfaces adapted to retain the sheet material therebetween when the clamp members are in the clamping position.

4. An anti-flap clamp according to claim 1 wherein the first longitudinal clamp member is length adjustable.

5. An anti-flap clamp according to claim 4 wherein the first longitudinal clamp is length adjustable telescopically.

6. An anti-flap clamp according to claim 5 which further includes a releasable frictional fastener to secure the telescopically adjustable first longitudinal clamp member against telescopic movement.

7. An anti-flap clamp according to claim 1 wherein the first longitudinal clamping member further includes a transverse member attachment means adapted to attach the first longitudinal clamping member to a fixture supporting the sheet material.

8. An anti-flap clamp adapted to secure an edge of a flexible sheet material, the clamp having a first longitudinal clamp member and a second longitudinal clamp member held together by clamp fastener means, the clamp fastener means being operable to secure the clamp members in a sheet clamping position from a sheet release position, the first and second longitudinal clamp members each having axially extending clamping parts adapted to engage along a margin of the edge of the sheet material to clamp the edge, wherein the second longitudinal clamp member comprises a C-shaped rail, so that no component of the clamp is required to be permanently secured to the sheet material and that the sheet material, when clamped, exhibits no or minimal lateral displacement at the margin when the clamp members are in the clamping position.

9. An anti-flap clamp according to claim 8 wherein the C-shaped rail includes an inner surface axially extending clamping part adapted to co-operate with the outer surface of the first longitudinal clamp member.

10. An anti-flap clamp according to claim 9 wherein the inner surface of the C-shaped rail includes a layer of resilient material.

11. An anti-flap clamp according to claim 10 wherein the axially extending clamping part of the first longitudinal clamp member is an outer surface of a hollow rail, the surface being equipped with projections, and wherein the resilient material is adapted to deform when clamped against the projections.

12. An anti-flap clamp according to claim 7 wherein the first longitudinal clamp member is connected at its opposite ends to the respective transverse member attachment means, the first longitudinal clamping members providing a fixed jaw carrying the axially extending clamping part of the first longitudinal clamping member and the second longitudinal clamp member providing a movable jaw carrying the axially extending clamping part of the second member.

13. An anti-flap clamp according to claim 1 wherein the first longitudinal clamp member and the second longitudinal clamp member are pivotally coupled together using a pivot connection.

14. An anti-flap clamp according to claim 13 wherein the first longitudinal clamp member includes an extending pivot rail extending parallel to the axially extending clamping part of the first longitudinal clamp member, and the second longitudinal clamp member includes an extruded C-shaped channel extending parallel to the axially extending clamping part of the second longitudinal clamp-member, the pivot rail being positioned in the C-shaped channel so that the axially extending clamping parts can pivot together between the sheet release and sheet clamping positions.

15. An anti-flap clamp adapted to secure an edge of a flexible sheet material, the clamp having a first longitudinal clamp member and a second longitudinal clamp member held together by clamp fastener means, the clamp fastener means being operable to secure the clamp members in a sheet clamping position from a sheet release position, the first and second longitudinal clamp members each having axially extending clamping parts adapted to engage along a margin of the edge of the sheet material to clamp the edge, wherein the clamp fastener means comprise longitudinally spaced apart quick release mechanisms having manually operable levers equipped with over center cam surfaces for over center toggle operation between the sheet clamping and sheet release positions, so that no component of the clamp is required to be permanently secured to the sheet material and that the sheet material, when clamped, exhibits no or minimal lateral displacement at the margin when the clamp members are in the clamping position.

16. An anti-flap clamp according to claim 15 wherein tension applied by each spaced quick release mechanism when in the sheet clamping position is adjustable.

17. An anti-flap clamp adapted to secure an edge of a flexible sheet material, the clamp having a first longitudinal clamp member and a second longitudinal clamp member held together by clamp fastener means, the clamp fastener means being operable to secure the clamp members in a sheet clamping position from a sheet release position, the first and second longitudinal clamp members each having axially extending clamping parts adapted to engage along a margin of the edge of the sheet material to clamp the edge, wherein the first longitudinal clamp member further includes at least one channel adapted to retain a second sheet material therein, so that no component of the clamp is required to be permanently secured to the sheet material and that the sheet material, when clamped, exhibits no or minimal lateral displacement at the margin when the clamp members are in the clamping position.

18. An anti-flap clamp according to claim 17 wherein there are two of the channels.

19. A collapsible awning assembly with improved anti-flap characteristics, the collapsible awning assembly comprising:

(1) a flexible sheet material supported at opposite sides by transverse members, the flexible sheet material having opposite free edges extending laterally of the transverse members and (2) at least one anti-flap clamp removably attached to the transverse members and adapted to extend substantially along a full length of at least one of the free edges, wherein each anti-flap clamp comprises a first longitudinal clamp member and a second longitudinal clamp member held together by clamp fastener means, the clamp fastener means being operable to secure the clamp members in a sheet clamping position from a sheet release position, the first and second longitudinal clamp members each having axially extending clamping means for gripping the edge of the sheet material along a margin of the sheet material to clamp the edge, so that no component of the clamp is required to be permanently secured to the sheet material and that the sheet material, when clamped, exhibits no or minimal lateral displacement at the margin when the clamp members are in the clamping position.

20. An elongate anti-flap clamp assembly to secure an edge of a flexible sheet material having spaced apart anti-flap clamps, each anti-flap clamp is according to claim 1.

21. A collapsible awning assembly according to claim 19 wherein the axially extending clamping means of the first longitudinal clamp member is an outer surface of a hollow rail, the surface being equipped with projections.

22. A collapsible awning assembly according to claim 19 wherein the first longitudinal clamp member is length adjustable.

23. A collapsible awning assembly according to claim 22 wherein the first longitudinal clamp is length adjustable telescopically.

24. A collapsible awning assembly according to claim 23 wherein further includes a releasable frictional fastener to secure the telescopically adjustable first longitudinal clamp member against telescopic movement.

25. A collapsible awning assembly according to claim 19 wherein the first longitudinal clamping member further includes a transverse member attachment means adapted to attach the first longitudinal clamping member to a fixture supporting the sheet material.

26. A collapsible awning assembly according to claim 19 wherein the second longitudinal member comprises a C-shaped rail.

* * * * *